US005416377A

United States Patent [19]

Kim

[11] Patent Number: 5,416,377

[45] Date of Patent: May 16, 1995

[54] SHADOW MASK ASSEMBLY USED IN COLOR CATHODE RAY TUBE

[75] Inventor: Seongwon Kim, Seoul, Rep. of Korea

[73] Assignee: Samsung Display Device Co., Ltd., Kyunggi, Rep. of Korea

[21] Appl. No.: 981,796

[22] Filed: Nov. 25, 1992

[30] Foreign Application Priority Data

Dec. 6, 1991 [KR] Rep. of Korea ..... 91-21601

[51] Int. Cl.[6] ..... H01J 29/07

[52] U.S. Cl. ..... 313/402; 313/406; 313/407

[58] Field of Search ..... 313/402, 404, 405, 406, 313/407, 408

[56] References Cited

U.S. PATENT DOCUMENTS

| | | | |
|---|---|---|---|
| 3,600,623 | 8/1971 | Vitale | 313/405 |
| 3,894,260 | 7/1975 | Sedivy | 313/405 |
| 3,912,564 | 10/1975 | Rogers | 313/402 |
| 3,921,024 | 11/1975 | Bakker et al. | 313/404 |
| 3,935,496 | 1/1976 | Gijrath | 313/402 |
| 3,943,399 | 3/1976 | Sedivy | 313/404 |
| 3,986,071 | 10/1976 | Groot | 313/404 |
| 3,999,098 | 12/1976 | Dougherty | 313/407 |
| 4,355,260 | 10/1982 | Dougherty | 313/404 |
| 4,652,792 | 3/1987 | Tokita et al. | 313/404 |
| 4,916,357 | 4/1990 | Nakamura et al. | 313/402 |

FOREIGN PATENT DOCUMENTS

| | | |
|---|---|---|
| 89-117242 | 7/1989 | Japan . |
| 89-117243 | 7/1989 | Japan . |

*Primary Examiner*—Sandra L. O'Shea
*Assistant Examiner*—Vip Patel
*Attorney, Agent, or Firm*—Christie, Parker & Hale

[57] ABSTRACT

A shadow mask assembly is formed such that a corner spring is attached to the side wall of a frame supporting a shadow mask. The corner spring has a supporting plate wherein a hole, into which a stud pin penetrates is formed at tile center; a pair of wings which extend in the direction of both sides of the supporting plate; and a welding plate which is formed by bending the supporting plate in a U-shape perpendicular to both wings. Minute space being formed between both wings and the side walls of the frame corresponding to the wings and facing and parallel to each other, and slots are inclined at an angle agreeing with a deflecting angle $\beta$ of an electron beam. Projections are combined with the slots, so that displacement by a thermal expansion of the frame is guided according to the deflecting angle.

6 Claims, 5 Drawing Sheets

SHADOW MASK ASSEMBLY USED IN COLOR CATHODE RAY TUBE

FIELD OF THE INVENTION

The present invention relates to a shadow mask assembly and, more particularly, to a shadow mask assembly appropriately structured such that stud pins are installed on all sides of the inside of a face panel of a color cathode ray tube.

BACKGROUND OF THE INVENTION

A color cathode ray tube of a shadow mask type has electron beams emitted from an electron gun which pass through apertures of the shadow mask to land on R, G, and B blue pixels, respectively, on a phosphorescent layer.

However, part of the electron beams pass through the apertures of the shadow mask and the rest strike the inner surface of the shadow mask so as to heat it. As a result, the shadow mask is thermally expanded and domes out, so that the position of the apertures is changed against the electron beams. Thus, a demand for compensating the change is proposed.

As a conventional method of solving the doming of the shadow mask, corner springs called hook springs are interposed between stud pins installed at a predetermined position on the inside of a face panel and a frame suspended from the stud pins so as to compensate the changing position of the apertures caused by the doming.

The corner springs are installed at the middle part or at the corners of the long and short sides of the frame.

A structure having corner springs installed on the corners of the frame has the advantage of suppressing the free vibrations of the frame.

The above method is disclosed in the U.S. Pat. Nos. 3,894,260, 3,935,496 and 3,986,071.

The suspending systems of the above inventions have in common clamping members attached to the edge of the frame.

The clamping member is provided with a pair of tension arms and the corner springs, so that it is welded at a predetermined position to the frame or connected to the frame by a locking member.

However, the above suspension system results in the increase of elements. Due to the complex structure, attaching and detaching the frame, performed many times during the assembling process, is difficult and more likely to change the elements.

Especially, the U.S. Pat. No. 3,894,260 proposes a new structure such that a stud member to support the end of the corner spring is installed on all edges of the face panel. However, it can not be manufactured with the manufacturing equipment of a conventional color cathode ray tube.

Since the face panel disclosed in the U.S. Pat. Nos. 3,921,024 and 3,935,496 should have a recess at all edges of the face panel having a corner spring, a metal mold for face panel, should be prepared.

The U.S. Pat. No. 3,986,071 discloses a structure in which a pair of stud pins are installed on the corner of the face panel to support both ends of the corner spring. However, this structure has the disadvantage of the unsettled suspending state of the corner spring.

The simplest corner spring structure supporting the corners of the frame is described in FIG. 4. This structure is proposed in the U.S. Pat. No. 4,652,792.

The corner spring 2 described in '792 has a welding plate 8 attached to the side wall of the solid frame 6 supporting the shadow mask and the one side end of a supporting plate 10 united together with the welding plate 8 by a weldment. The supporting plate 10 is outwardly bent in a V shape against the welding plate and the end of supporting plate 10 and is extended parallel to welding plate 8 to form a plate 16. The plate 16 has a hole 18 into which the stud pin 14 penetrates.

FIG. 5 shows an assembling state where the supporting plate 10 forms a predetermined angle $\theta$ against the plate 16.

Here, a relationship of a deflecting angle $\beta$ between an electron gun and an effective face of the shadow mask 4 and a bending angle $\theta$ of the supporting plate is $\theta+\beta=90°$.

However, this new suspension system also has some problems in the attaching and detaching process which is performed many times during an assembling process.

The supporting plate 10 receives a force applied in the direction of arrow x as shown in FIG. 4, so that, it is bent as a dotted line, as shown in FIG. 5, to be plastically deformed in a predetermined angle $\theta$.

In addition, since the weight of frame 6 is concentrated in the supporting plate 10, when frame 6 is vibrated in the direction of arrow Y as shown in FIG. 4, the supporting plate 10 is twisted against the welding plate 8.

Japanese Patent Laid-Open Nos. 89-117242 and 89-117243 propose a solution for the above deformation problem.

However, any conventional technique has such a structure that a displacement of the frame by the thermal expansion can not agree to the deflecting angle $\beta$ of the electron beam.

Thus, an initial operation of the conventional color cathode ray tube results in a misconvergence and mislanding which lengthens the picture display time.

SUMMARY OF THE INVENTION

An object of the present invention is to provide an improved shadow mask assembly for a color cathode ray tube wherein it can securely suspend a frame; there is no problem, even though the attaching and detaching process occurs many times; and the displacement of the frame caused by the thermal expansion agrees to the deflecting angle of an electron beam.

To achieve the object, the present invention proposes a shadow mask assembly where corner springs are attached to the side walls of a frame supporting a shadow mask. Each corner spring has a supporting plate wherein a hole in which a stud pin penetrates is formed at the center; a pair of wings which are extended at the direction of both sides of the supporting plate; and a welding plate which is formed by bending the supporting plate in a U-shape perpendicular to both wings. Minute space being formed between both wings and the side walls of the frame corresponding to the wings and facing and parallel to each other, and slots are inclined at an angle agreeing to a deflecting angle $\beta$ of the electron beam. Projections are combined with the slots, so that displacement by thermal expansion of the frame is guided to the direction agreeing with the deflecting angle $\beta$.

BRIEF DESCRIPTION OF THE DRAWINGS

Other objects and further advantages of the present invention will be apparent in the following detailed description in connection with the accompanying drawings, in which.

DETAILED DESCRIPTION OF A PREFERRED EMBODIMENT

Figure 1:
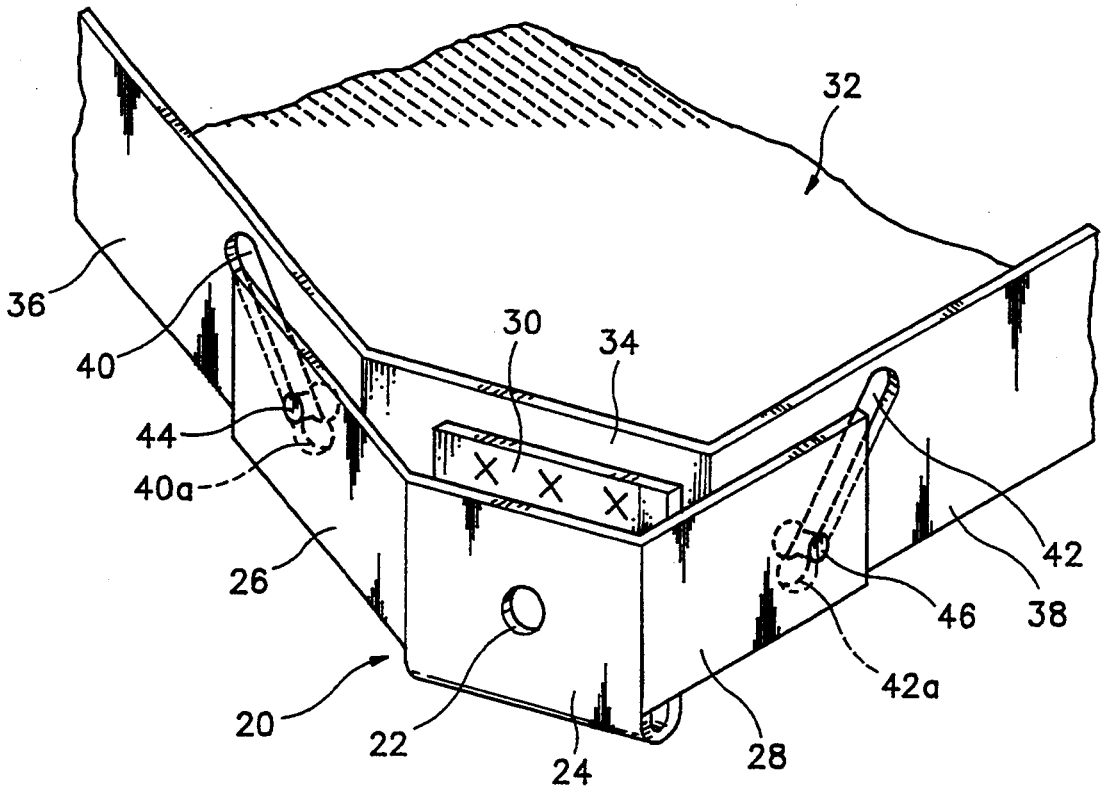
FIG. 1 is a perspective view of a shadow mask assembly of the present invention.

In FIG. 1, a corner spring is represented as reference numeral 20. The corner spring 20 has a plate 24 in which a hole is formed nearly at its center.

The plate 24 has wings 26, 28 which are extended in the direction of both sides and a welding plate 30 which is bent perpendicular to two wings 26, 28 so as to face the plate 24.

The welding plate 30 is attached to an attaching surface 34 of a frame 32 by a weldment.

The corner springs each are disposed on all corners of the frame 32.

The wings 26, 28 are disposed along the side surfaces 36, perpendicularly extending to both sides of the attaching surface 34. The wings 26, 28 are minutely apart from the side surfaces 36, 38.

So, the wings 26, 28 are bent perpendicular to each other.

The side surfaces 36, 38 and the wings 26, 28 are connected to each other by inclined slots 40, 42 and projections 44, 46.

In the present embodiment, an inclination of the slots 40, 42 is equal to a deflecting angle $\beta$ of electron beams. Therefore, the slots are inclined to substantially compensate for displacement of the frame due to thermal expansion.

The inclined slots 40, 42 are formed on the side surfaces 36, 38 of the frame 32. The projections 44, 46 corresponding to the slots 40, 42 are provided in the wings 26, 28.

Figure 2A:
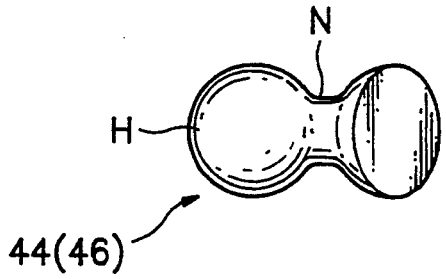
FIG. 2A is a perspective view of a projection of FIG. 1.

As shown in FIG. 2, the projections 44, 46 have a neck N having almost the same diameter as that of the slots 40, 42 and a head H formed in a bead shape united with the neck N. The projections 44, 46 are fixed by a method such as an electric weldment. This structure prevents the projections from quitting the slots.

In case that the head of the projection is formed in the bead shape as described above, to easily connect the projection with the slot, expanded parts 40*a*, 42*a* which have the longer diameter than that of the head are formed at the one end of the slots 40, 42.

Figure 2B:
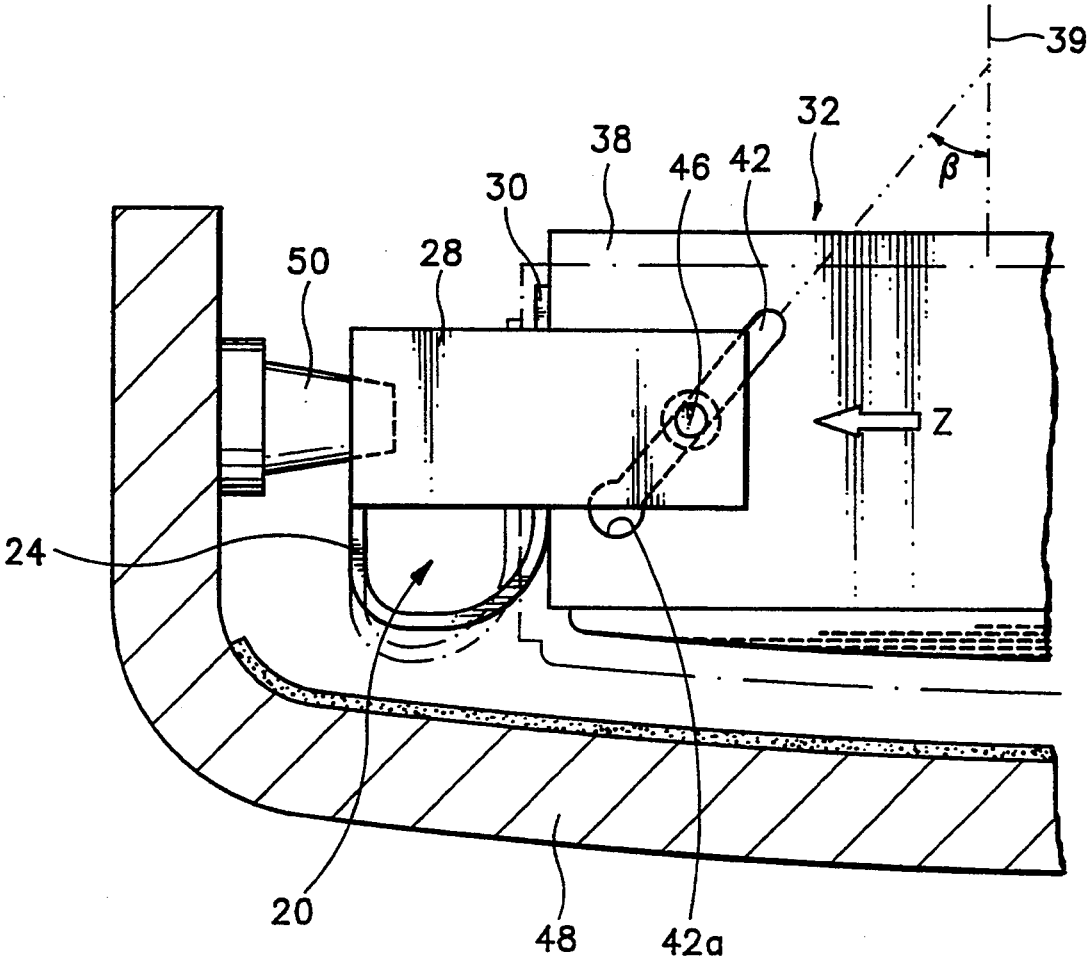
FIG. 2B is a side sectional view of an installation state of a structure of FIG. 1 at the inside of a faceplate.

FIG. 2B describes in a side sectional view a suspending state such that a stud pin 50 disposed on a conventional faceplate 48 is inserted in the hole 22. This figure shows that a weight of the frame 32 is substantially applied to the stud pin 50 through the welding plate 30 and the plate 24.

Also, in the color cathode ray tube to which the present invention is applied, the frame 32 should be attached and detached from the faceplate many times during an assembly process.

In that process, to prevent changing elasticity between the plate 24 and the welding plate 30 forming the corner spring 20, the welding plate 30 is bent nearly in a U-shape, so that a bending part thereof has preferably a large bending moment.

Figure 4:
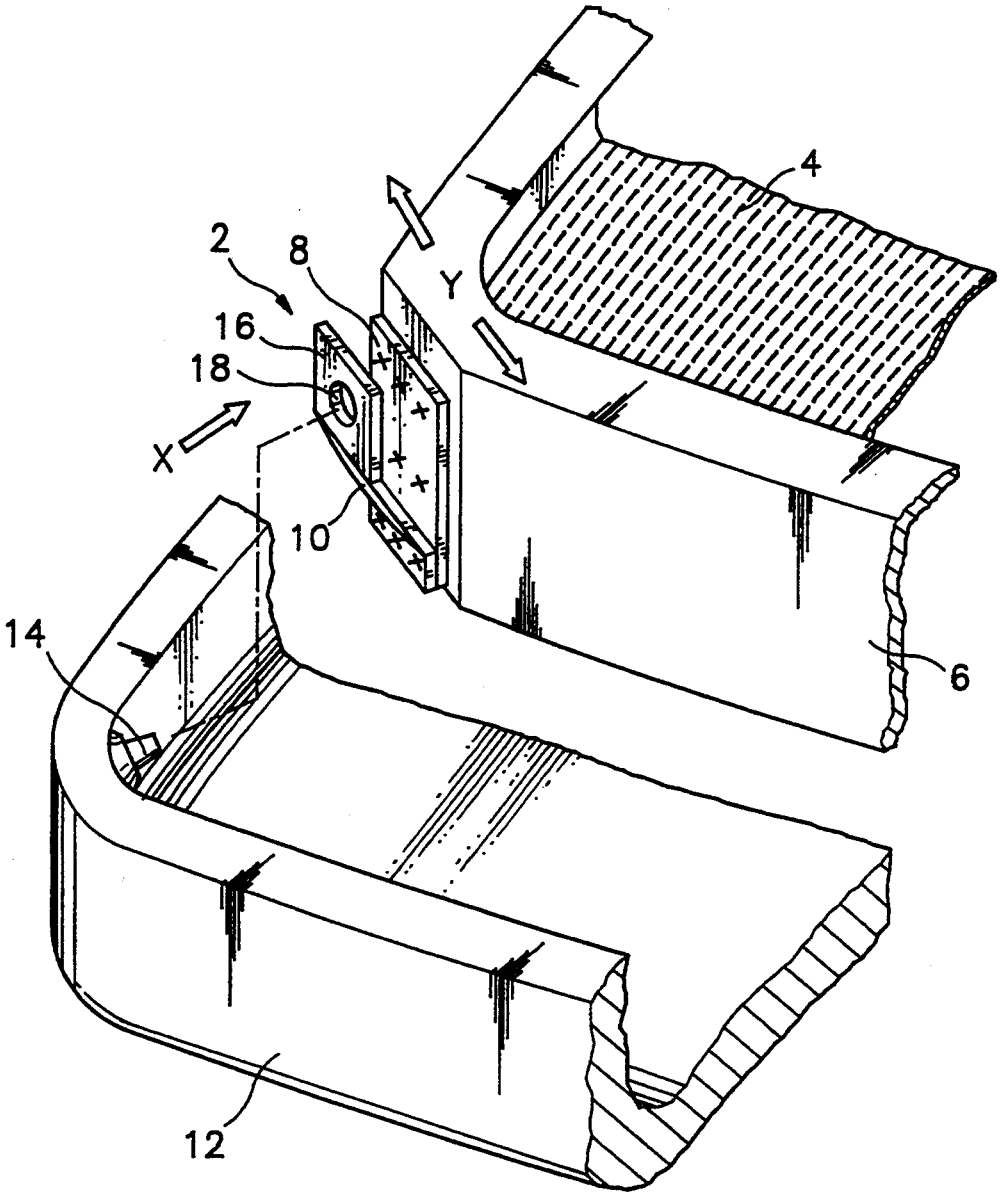
FIG. 4 (Prior Art)
FIG. 4 is an partial exploded perspective view of a suspension structure of a frame applied to a conventional method.
Figure 5:
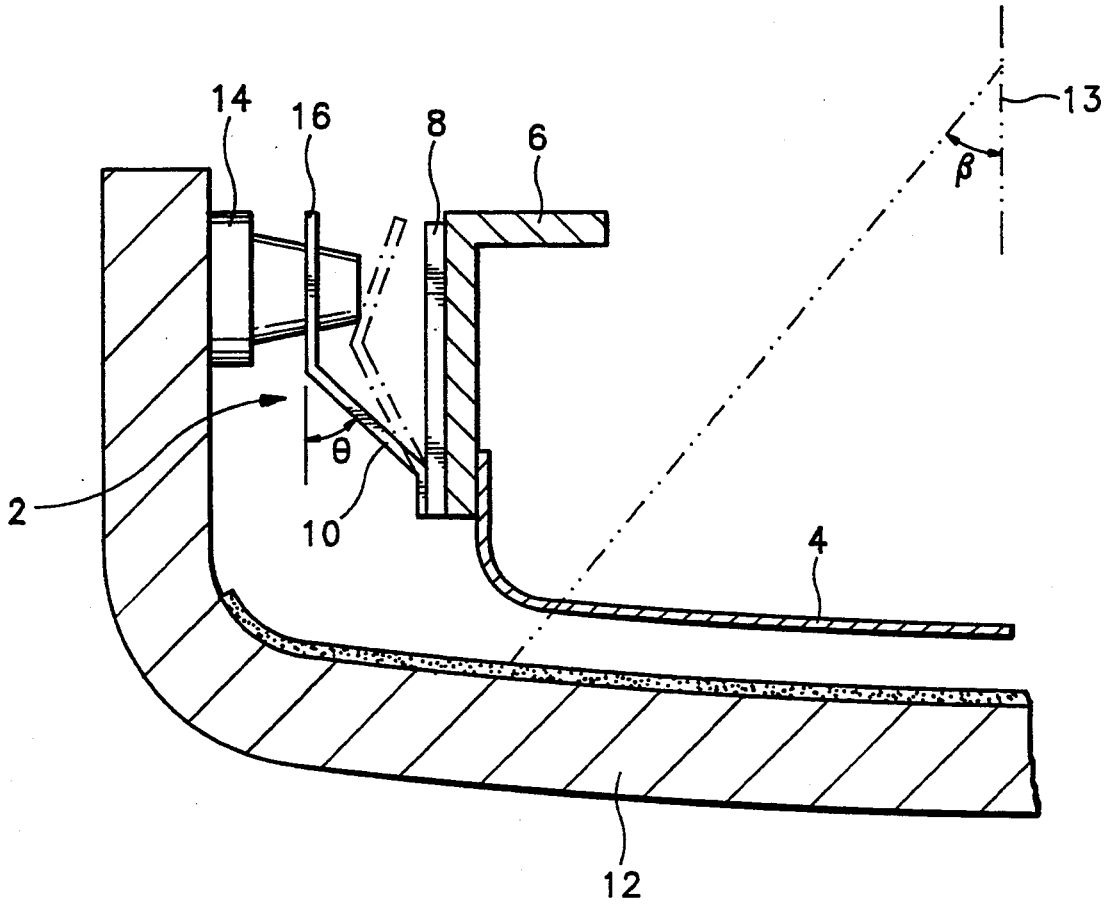
FIG.5 (Prior Art)
FIG. 5 is a side sectional view of an assembling state of FIG. 4.

Due to two wings 26, 28 which are extended to both side surfaces of the plate 24 and opposed parallel to the side surfaces 36, 38 of the frame 32, as shown in FIG. 4, vibrations which are generated in an arrow Y direction of the frame 32 by an external impact are positively suppressed and a bending part of the U-shape joining the plate 24 to the welding plate 30 prevents the plates from being deformed.

The direction of a thermal expansion of the frame 32 is equal to an arrow Z direction of FIG. 2B. However, according as the slots 40,42 formed on the side surfaces 36, 38 of the frame 32 are guided by the projections 44, 46 of the wings 26, 28, the direction of the arrow z is equal to that of the deflecting angle of electron beams.

At that time, since the corner spring 20 is thermally expanded in the direction shown as a dotted line in the figure, the frame 32 is rapidly moved in the vicinity of the panel 48 agreeing with the deflecting angle $\beta$ of the electron beam.

As the moving direction of the frame 32 agrees with the deflecting angle $\beta$ of the electron beam, the aperture of the shadow mask will always agree to a radiating path of the electron beam so the electron beam will not erroneously converge or land.

Thus, the present invention has the advantages that the displaying time of an initial screen becomes short and the picture quality is improved.

Figure 3:
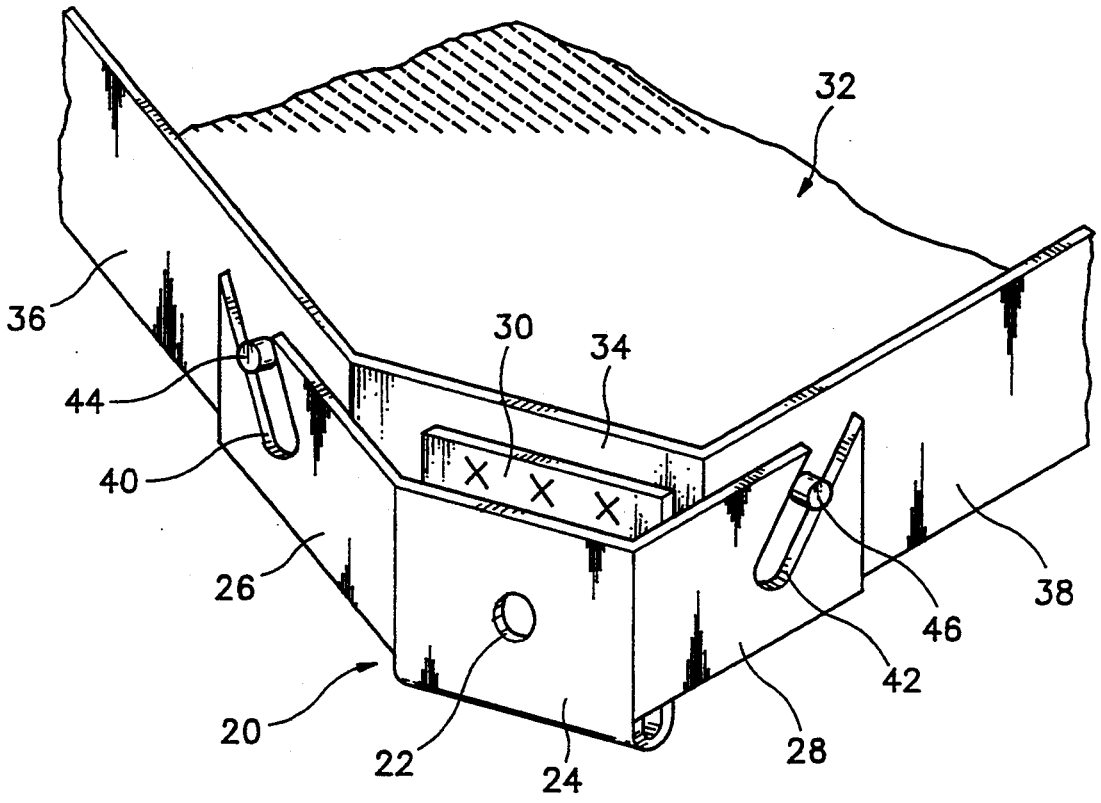
FIG. 3 is a side sectional view of FIG. 2B.

FIG. 3 describes the other embodiment of the shadow mask relative to the present invention.

This embodiment shows that side walls 36, 38 have projections 44, 46 and inclined slots 40, 42 which correspond those projections formed on both wings 26, 28 of corner spring 20.

One end of slots 40, 42 is open and, of course, the inclination thereof is the same as the deflecting angle $\beta$ of the electron beams.

The operating effect obtained by the connection of the projections 44, 46 with the slots 40, 42 is the same as that of the former embodiment. Especially, since projections 44, 46 are connected to the open one ends of the slots 40, 42, they can be easily assembled and the projections 44, 46 have a simple pin type.

As described above, the shadow mask assembly of the present invention can prevent the electron beams from misconverging or mislanding by helping the thermal expansion direction of the frame to agree to the deflecting angle of the electron beam. The present invention can also suppress vibrations in a circular direction of the frame by both wings of the corner spring. Further, the shadow mask assembly can reduce a color reproduction error, prevent a changing of the corner spring, and a weakening of elasticity caused by an external impact by the large bending moment obtained by bending shape of U type formed between the supporting plate and the welding plate.

What is claimed is:

1. A shadow mask assembly for use in a color cathode ray tube having a corner spring attached to an attaching surface of an edge of a frame, the assembly comprising:

a plate having a hole formed at its center into which a conventional stud pin penetrates;

a pair of wings extending from both side directions of the plate, each wing parallel to and spaced apart from a corresponding side wall of the frame;

a welding plate which is bent in a nearly U-shape extending from the plate; and slot and projection assemblies, each including a slot on the wing and a projection on the side wall, for coupling each wing to a corresponding side surface of the frame, each slot inclined to substantially compensate for displacement of the frame due to thermal expansion.

2. The shadow mask assembly as claimed in claim 1, wherein the projections have a neck having almost the same diameter as that of the slots and a head formed in a bead shape united with the neck and the slots have an expanded part with a longer diameter than that of the head formed.

3. The shadow mask assembly as claimed in claim 1, wherein one side of the slot is open.

4. A shadow mask assembly for use in a color cathode ray tube having a corner spring attached to an attaching surface of an edge of a frame, the assembly comprising:

a plate having a hole formed at its center into which a conventional stud pin penetrates;

a pair of wings extending from both side directions of the plate, each wing parallel to and spaced apart from a corresponding side wall of the frame;

a welding plate which is bent in a nearly U-shape extending from the plate; and slot and projection assemblies, each including a slot on the side wall and a projection on the wing, for coupling each wing to a corresponding side surface of the frame, each slot inclined to substantially compensate for displacement of the frame due to thermal expansion.

5. The shadow mask assembly as claimed in claim 4, wherein the projections have a neck having almost the same diameter as that of the slots and a head H formed in a bead shape united with the neck, and the slots have an expanded part of a longer diameter than that of the head formed at its one end.

6. The shadow mask assembly as claimed in claim 4, wherein the one side of the slot is open.

* * * * *